United States Patent [19]

Stritzl

[11] Patent Number: 5,033,768

[45] Date of Patent: Jul. 23, 1991

[54] FRONT JAW

[75] Inventor: Karl Stritzl, Vienna, Austria

[73] Assignee: TMC Corporation, Baar, Switzerland

[21] Appl. No.: 498,021

[22] Filed: Mar. 23, 1990

[30] Foreign Application Priority Data

Mar. 28, 1989 [AT] Austria ..... 698/89

[51] Int. Cl.[5] ..... A63C 9/08

[52] U.S. Cl. ..... 280/625; 280/628

[58] Field of Search ..... 280/623, 625, 626, 628, 280/631, 633

[56] References Cited

U.S. PATENT DOCUMENTS

| | | | |
|---|---|---|---|
| 4,166,636 | 9/1979 | Svoboda et al. | 280/625 |
| 4,268,064 | 5/1981 | Svoboda | 280/625 |
| 4,431,210 | 2/1984 | Nitschko | 280/625 |
| 4,434,997 | 3/1984 | Nitschko | 280/625 |
| 4,449,730 | 5/1984 | Oberleitner et al. | 280/625 |
| 4,974,869 | 12/1990 | Muhlberger et al. | 280/625 |

FOREIGN PATENT DOCUMENTS 2044264 3/1971 Fed. Rep. of Germany .

*Primary Examiner*—Andres Kashnikow
*Assistant Examiner*—Michael Mar
*Attorney, Agent, or Firm*—Flynn, Thiel, Boutell & Tanis

[57] ABSTRACT

A front jaw provided with two laterally extending angle levers adapted to hold a ski boot to an upper surface of a ski, which angle levers can be pivoted outwardly against the force of a release spring housed in a housing and through which extends a pull rod. In order to provide a compact design, the invention provides that the pivot axes of the two angle levers be arranged in a bearing part which is pivotal about a transverse axis extending in an upper area of the housing on a side facing the ski boot.

9 Claims, 6 Drawing Sheets

FRONT JAW

FIELD OF THE INVENTION

The invention relates to a front jaw of a ski binding.

BACKGROUND OF THE INVENTION

The purpose of the invention is to provide a front jaw having a compact design. A pivoting movement of the releasing one of the two angle levers also in upward direction in a predetermined degree is thereby supposed to be possible during a backward twisting fall of the skier.

Starting out from a front jaw, this purpose is attained according to the invention with the pivot axes for the two angle levers being arranged in a bearing part pivotal about a transverse axis located in an upper area of the housing on a side facing the ski boot, and with the two angle levers resting with their shorter lever arm on a vertically extending leg of a slide member loaded by the pull rod. Due to the fact that compared with the known designs only one single bearing part is needed, it is possible by using basic elements of existing front jaws to manufacture inventive front jaws, in which during a backward twisting fall the ski boot is easier released.

Actually it is already known in a front jaw having two laterally extending angle levers which grip around the sole of the boot and which are under the influence of a release spring, and a sole down-holding means between the two angle levers being arranged on a vertical adjusting screw to pivotally support the adjusting screw in a plane extending transversely with respect to the longitudinal direction of the ski and perpendicularly with respect to the upper side of the ski (see Austrian Patent No. 361 347 corresponding to U.S. Pat. No. 4,268,065). The adjusting screw is in this front jaw held by the two angle levers in the travelling or position of use so that a movement of the lower end of the adjusting screw in a slotted hole extending in transverse direction is not possible. If, however, a backward twisting fall of the skier occurs, then the lower end of the adjusting screw is released by the releasing angle lever, and the sole holder can pivot toward this side in a normal plane with respect to the longitudinal axis of the ski against a resilient element.

One of the front jaws has the advantage that after a backward twisting fall, the pivoted angle lever holds the end of the adjusting screw among others through friction, so that a return of the angle lever and of the sole holder into the position ready for stepping in is not possible (see FIG. 8). The adjusting screw is in a different one of these front jaws held in its center position by a separate spring element (see FIGS. 1–6).

The provision of two inclined surfaces in the lower area of the side of the housing, which side faces the ski boot guarantees a safe guiding of the bearing part at the start of a backward fall. The two inclined surfaces define an acute angle ($\alpha$) with the upper side of the ski and on which the bearing part rests with counter surfaces in the travelling position of the front jaw.

A projection on the housing enables a safe guiding of the bearing part on the housing at the start of a backward twisting fall of the skier and a subsequent release of the bearing part therefrom enabling a pivoting of the same in a transverse plane with respect to the upper side of ski. Thus, the bearing part is blocked against a rotary movement in transverse direction until a predetermined angular position is reached.

To support the bearing part on the housing, axle journals can be provided on the bearing part, which has the advantage of being simple to mount/assemble.

An initial tension in the release spring is caused by a pull rod and during a backward fall and also during a backward twisting fall causing the bearing part to pivot, the pull rod compresses the spring. The bearing part causes less force to be required for effecting a lateral release. The friction between a further cross bar and the leg of a slide member is in a further development of this thought of the invention additionally reduced by providing a sloped surface on the further cross bar.

The provision of axle journals on the housing guarantees a surface contact of the bearing part on the housing during the entire backward fall or rather at the start of a backward twisting fall. This reduces the wear of the bearing part and the binding housing.

An inverted T-shaped recess in the bearing part assures that during a backward twisting fall of the skier, the bearing part is pivoted about an ideal axis extending in longitudinal direction of the ski only after the bearing part has already covered a predetermined path upwardly, thus a path directed away from the ski.

BRIEF DESCRIPTION OF THE DRAWINGS

Embodiments of the subject matter of the invention are illustrated as examples in the drawings, in which.

DETAILED DESCRIPTION

Figure 1:
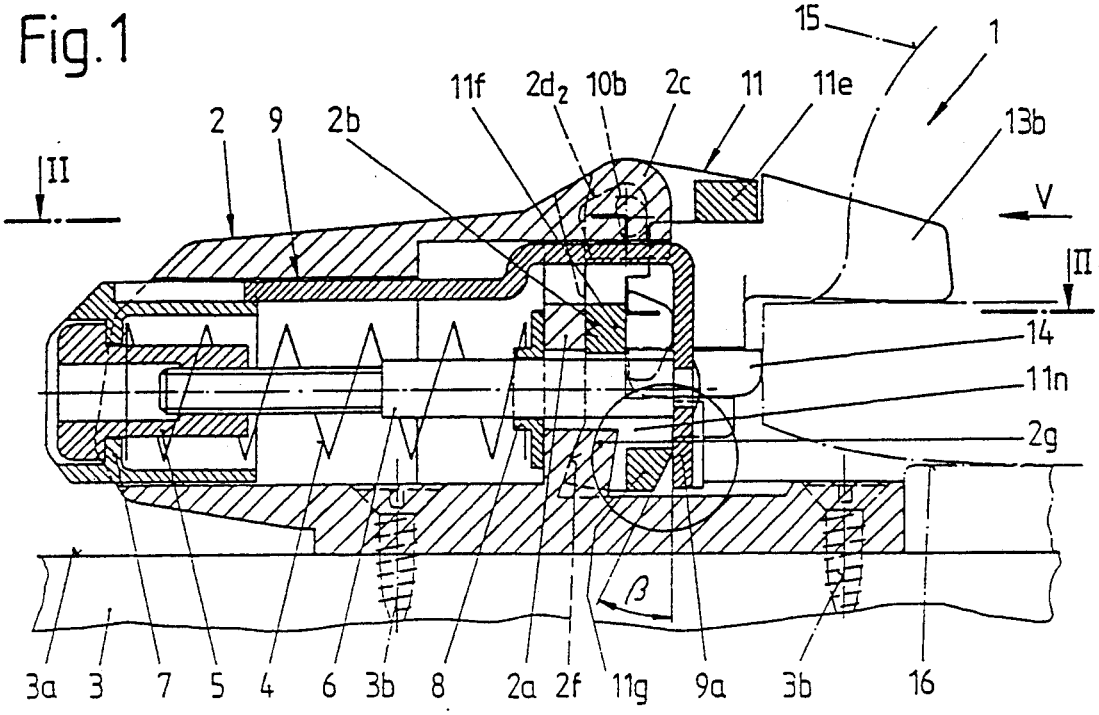
FIG. 1 is a vertical, central longitudinal cross-sectional view of a first embodiment in a travelling or position of use.
Figure 1A:
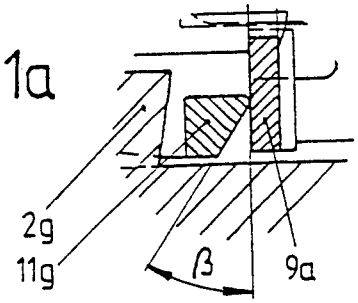
FIG. 1*a* is an enlarged fragment of the sectional view illustrated in FIG. 1.

The front jaw illustrated in FIGS. 1 to 9 is identified in its entirety by the reference numeral 1. The front jaw has a housing 2 secured by means of screws 3*b* to the upper side 3*a* of a ski 3. A release spring 4, designed as a coil or compression spring, is housed in the housing 2, the initial tension of which release spring can be adjusted in a conventional manner by a threaded sleeve 5. The release spring 4 is arranged between two spring washers 7, 8, of which the spring washer 8 rests on a partition 2*a* of the housing 2. A pull rod 6 extends in axial direction through the central part of the release spring 4. The threaded sleeve 5 is screwed onto one end of the pull rod and a vertically extending leg 9*a* of an angular slide member 9 is swaged to the other end of the pull rod.

On a front side 2*b* of the housing, which front side faces a ski boot 15 with a stepping plate 16, which ski boot and stepping plate is only indicated in FIG. 1, there is provided a shoulder 2*c* into which two downwardly opening laterally extending recesses $2d_1$, $2d_2$ are provided, which recesses are arranged symmetrically with respect to the vertical, central longitudinal plane of the housing 2. An inwardly directed axle journal 10*a*, 10*b* of a bearing part 11 (see FIG. 9) is guided with sufficient clearance into each one of the recesses $2d_1$, $2d_2$ (see FIGS. 1, 5 and 7).

The bearing part 11 (FIG. 9) has sections 11*a*, 11*b*, which are approximately C-shaped in the side view and which are spaced laterally from one another and are provided with bearing bores 11*c*, 11*d*. Each section 11*a*, 11*b* has an inclined surface 11*h*, 11*i* at its lower end, which inclined surface is designated to rest on an inclined surface 2*e* or 2*f* (FIGS. 7,8) inclined at an angle $\alpha$ on the front side 2*b* of the housing 2. The opposing or facing inner sides of the two sections 11*a*, 11*b* carry the axle journals 10*a*, 10*b* (see FIGS. 4, 7 and 9).

The two sections 11*a*, 11*b* are connected by three cross bars 11*e*, 11*f* and 11*g*, thus forming two spaces, namely a lower space 11*n* and an upper space 11*p*. The lower cross bar 11*g* is adapted to rest on the vertical leg 9*a* of the slide member 9. The front facing surface of the cross bar 11*g* defines an acute angle $\beta$ with the vertical leg 9*a* of the slide member 9, with the upper edge of the cross bar 11*g* being thereby rounded (see FIG. 1).

Bearing bolts 12*a*, 12*b* extend through the bearing bores 11*c* and 11*d*. Angle levers or two-arm levers 13*a*, 13*b* are pivotally supported on the bearing bolts. The shorter lever arm of each angle lever 13*a*, 13*b* urged against the leg 9*a* of the slide member 9 by means of the pull rod 6 loaded or biassed by the release spring 4. The two angle levers 13*a*, 13*b* are in this manner pressed against the toe portion of the ski boot 15. A projection 2*g* exists in the lower area of the front side 2*b* of the housing 2, which projection in the travelling or position of use of the front jaw 1 extends into the lower space 11*n* between the two sections 11*a*, 11*b* of the bearing part 11 to center the bearing part 11 with respect to the housing 2. Rollers are identified by the reference numeral 14, on which rollers is supported the sole of the ski boot 15 in the travelling or position of use of the front jaw 1.

Figure 2:
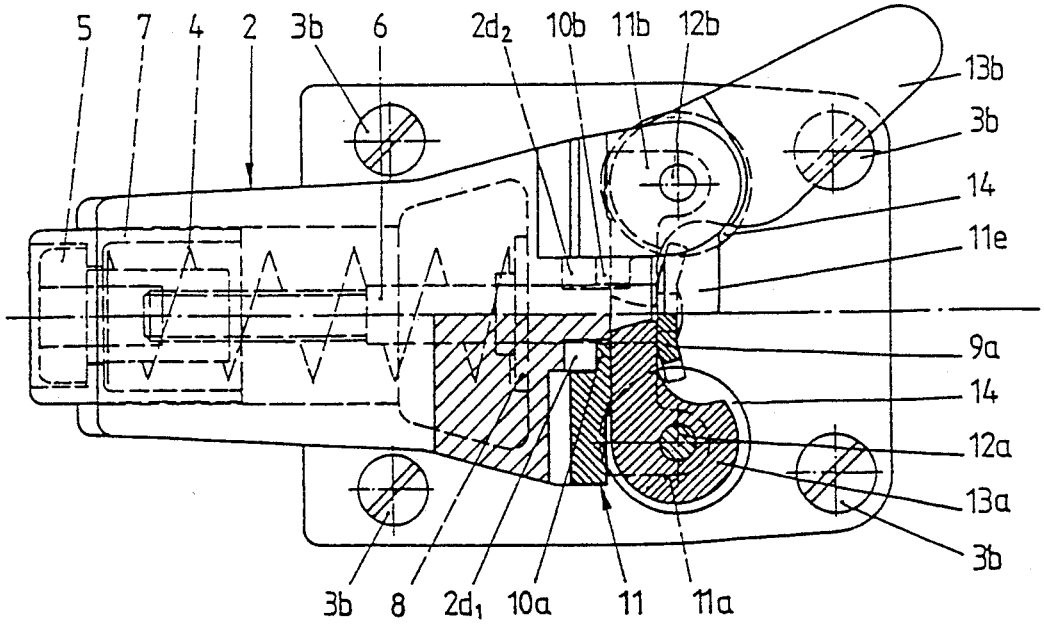
FIG. 2 is an associated top view of the first embodiment partially in cross section taken along the line II—II of FIG. 1.
Figure 3:
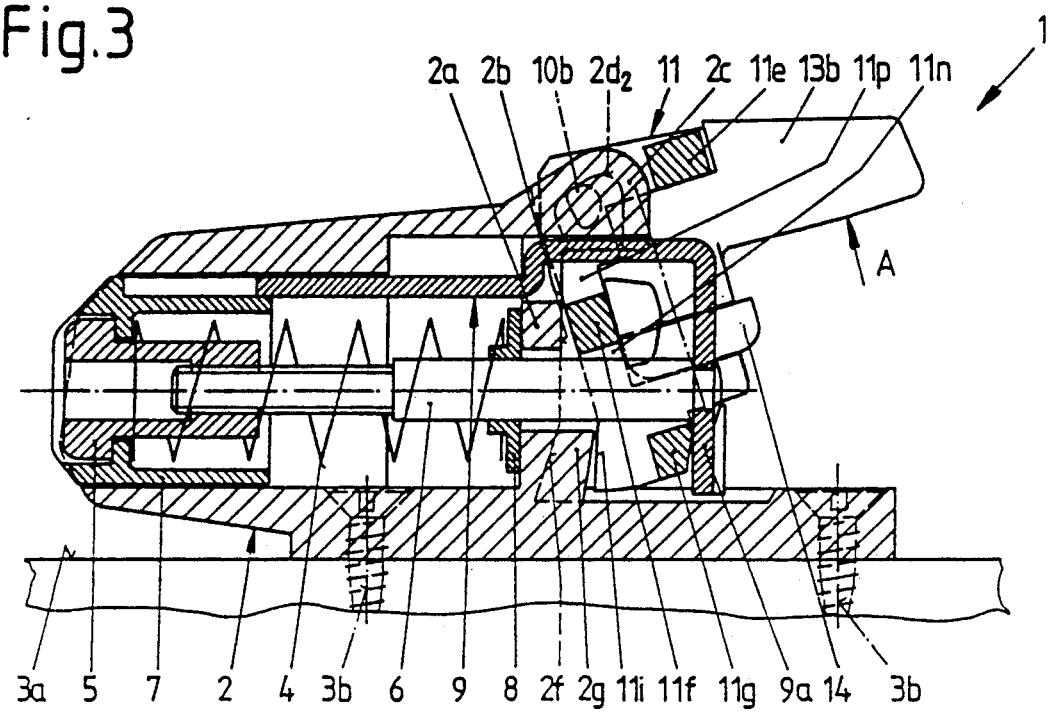
FIG. 3 is a vertical central longitudinal cross-sectional view of the first embodiment during a backward twisting fall.
Figure 4:
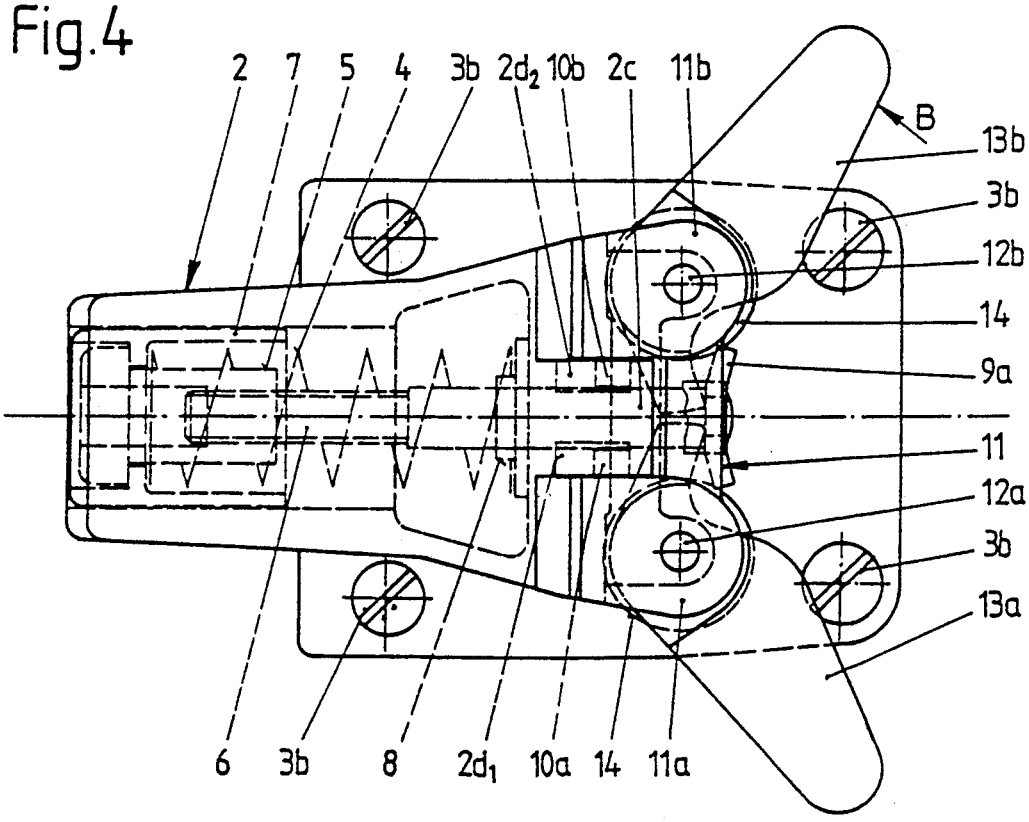
FIG. 4 is a top view during a twisting fall.
Figure 5:
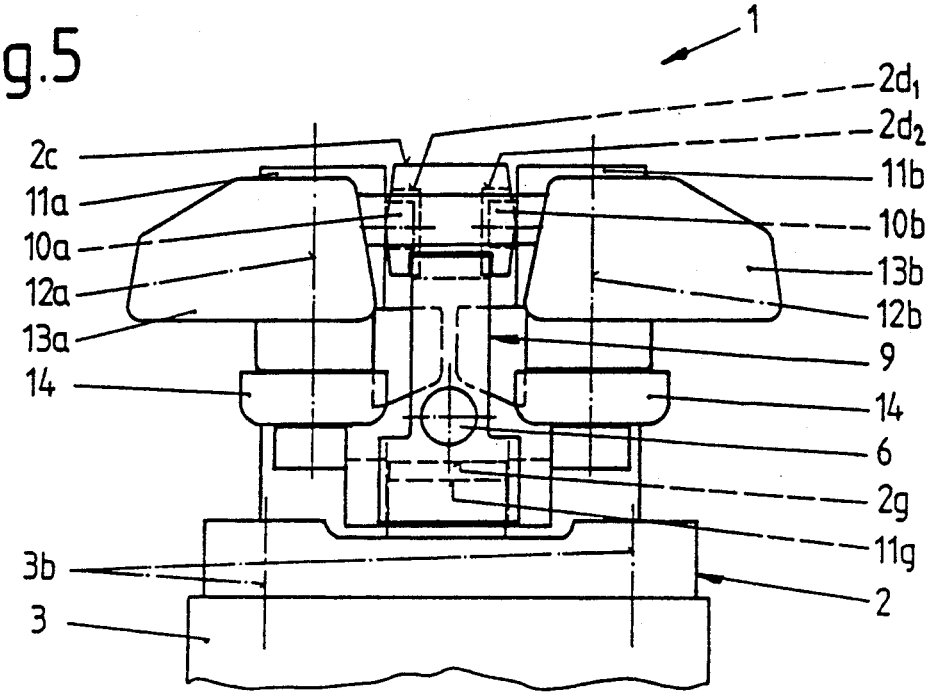
FIG. 5 illustrates a view in direction of the arrow V in FIG. 1.
Figure 6:
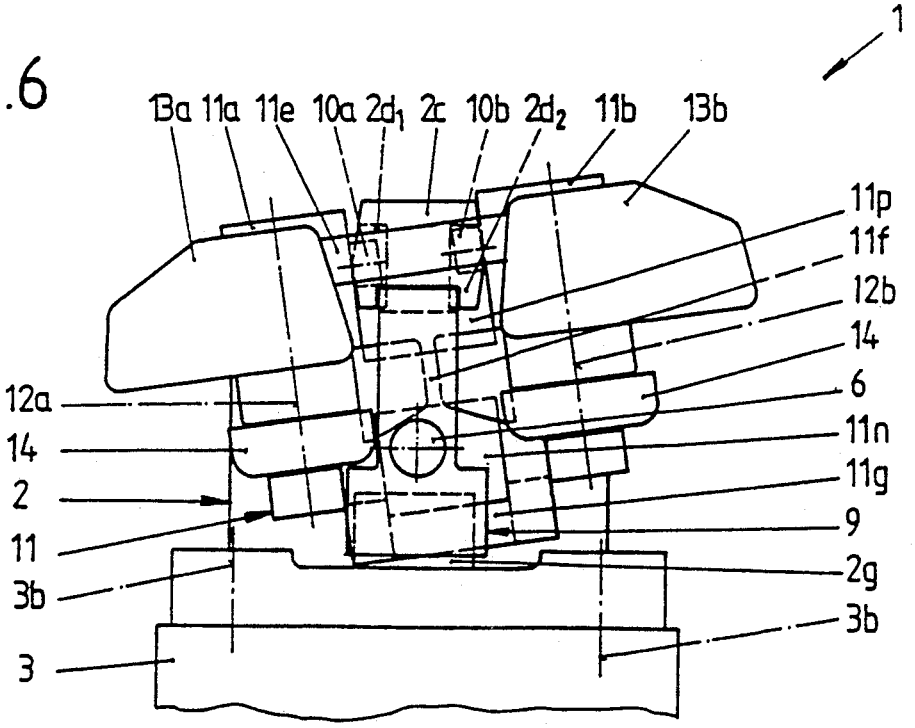
FIG. 6 illustrates the same view during a backward twisting fall.
Figure 7:
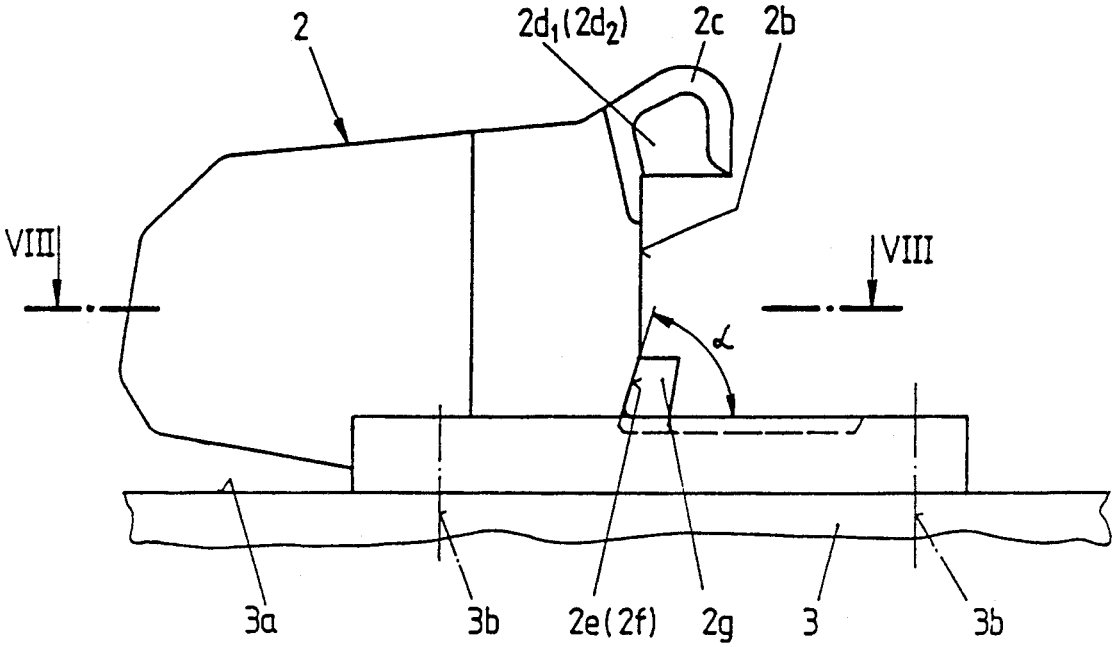
FIG. 7 is a side view of the housing.
Figure 8:
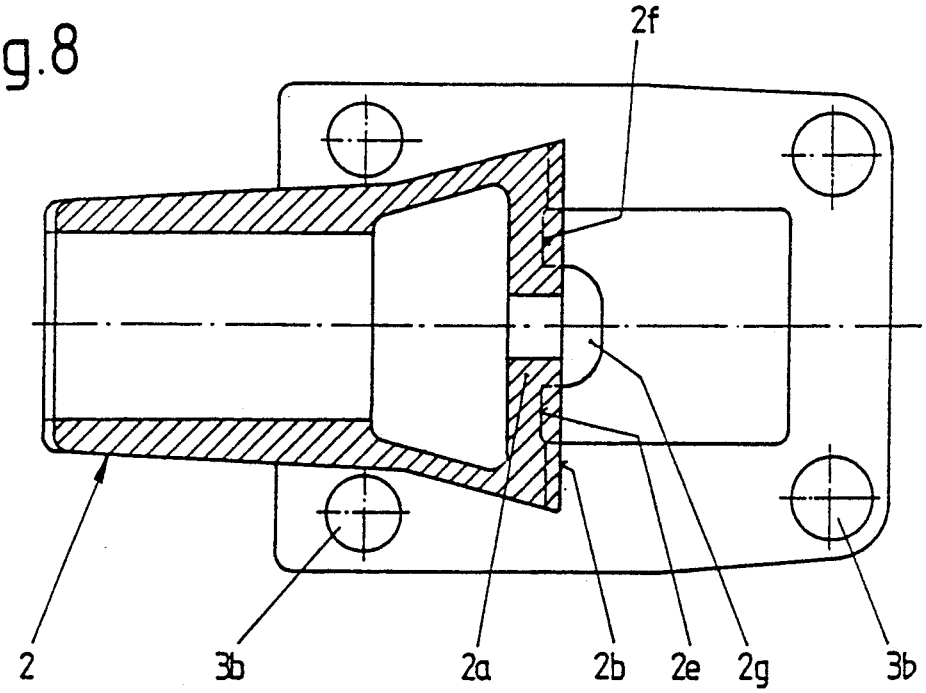
FIG. 8 is a cross-sectional view taken along the line VIII—VIII of FIG. 7.
Figure 9:
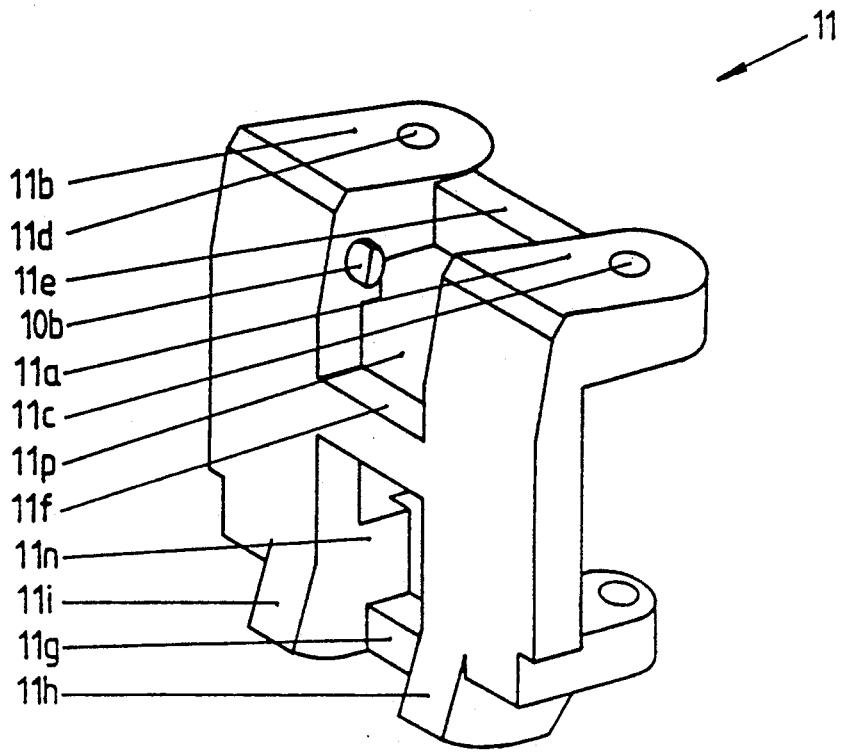
FIG. 9 is a perspective view of the bearing part.

All elements assume the position illustrated in FIGS. 1 and 2 in the travelling position. If a backward fall of the skier occurs, the bearing part 11 is pivoted about its axle journals 10*a*, 10*b* corresponding with an ideal transversely extending axis, with the cross bar 11*g* acting onto the vertical leg 9*a* of the slide member 9 and the initial tension of the release spring 4 being increased. The work required for effecting a lateral release of the toe of the ski boot is thus reduced. If a backward twisting fall of the skier occurs, then the bearing part 11 is pivoted counterclockwise about the axis formed by the two axle journals 10*a*, 10*b*. However, the projection 2*g* leaves thereby the lower space 11*n* between the two sections 11*a*, 11*b* of the bearing part 11 so that the part 11 can pivot due to the clearance between the axle journals 10*a*, 10*b* and the recesses $2d_1$, $2d_2$, about an ideal axis extending in longitudinal direction of the front jaw 1 (see FIG. 6). This, however, reduces the friction between the angle lever 13*a* or 13*b* pivoted out by the force B (see FIG. 4) of the ski boot 15, so that the ski boot 15 has an easier time leaving the front jaw 1. The forces A (FIG. 3) and B form in practice a resulting forcing, which is applied by the ski boot 15 onto one of the two angle levers 13*a*, 13*b*. Thus this front jaw 1 has during a backward twisting fall a controlled diagonal release as its basis.

Figure 12:
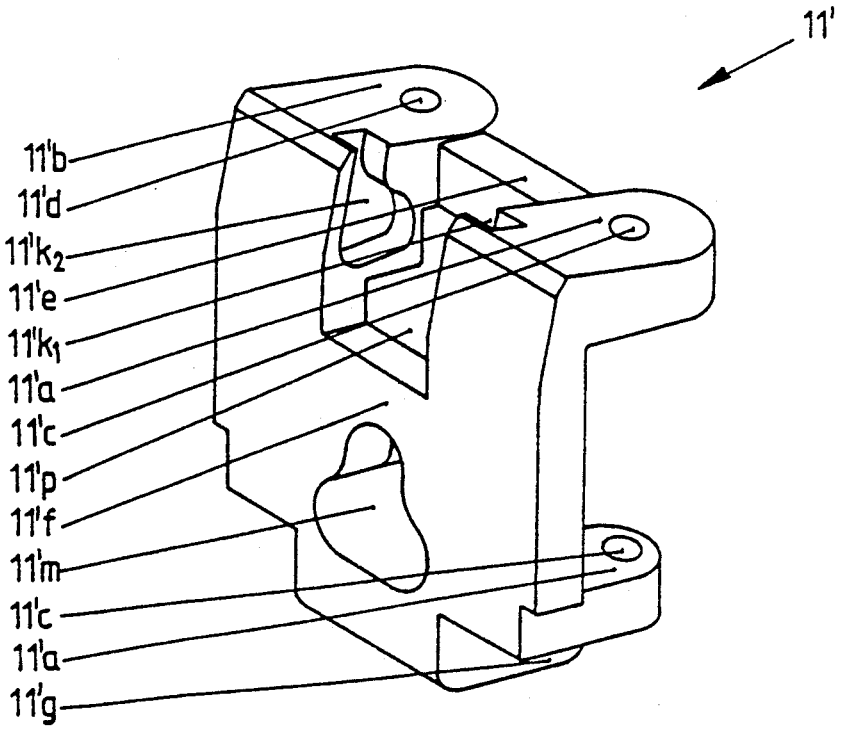
FIG. 12 is a perspective view of the bearing part of the second embodiment.
Figure 10:
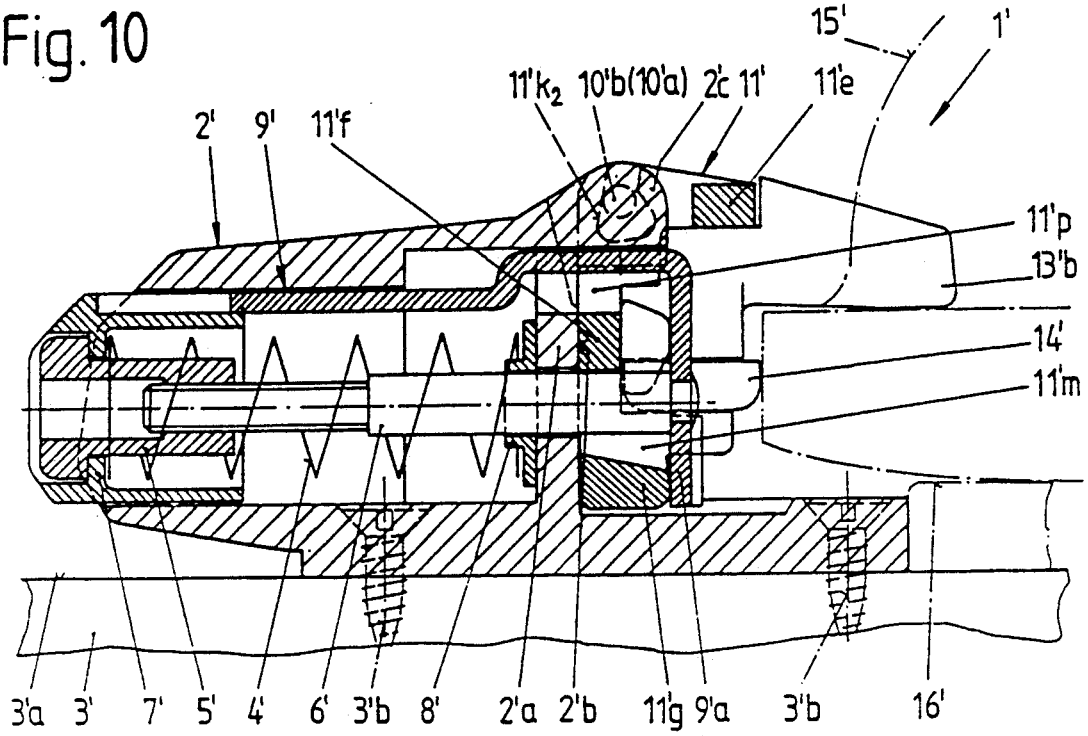
FIG. 10 is a vertical, central longitudinal cross-sectional view of a second embodiment in the travelling or position of use.
Figure 11:
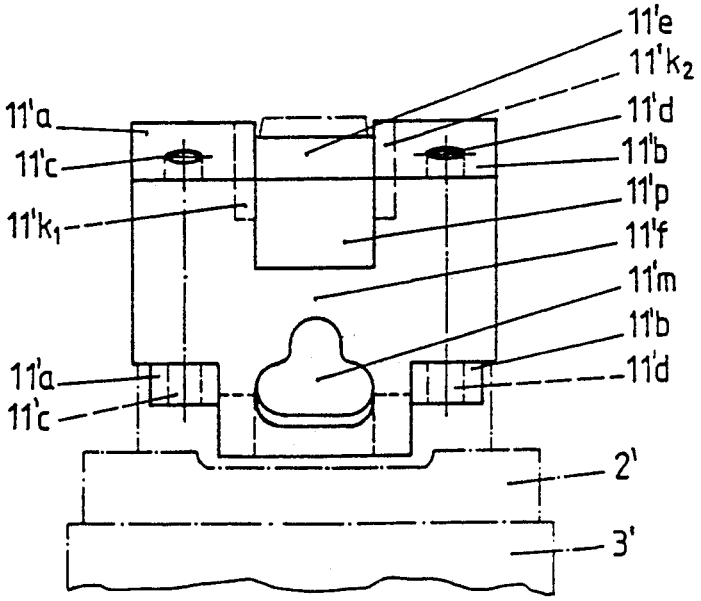
FIG. 11 is a front view of the bearing part of the second embodiment.

The second embodiment of a front jaw 1' illustrated in FIGS. 10 to 12 is similar to the first one. Therefore, the same structural parts have the same reference numerals, however, they include prime mark (') to distinguish from the first embodiment.

The front jaw 1' has also a shoulder 2'*c* on the front side 2'*b* of the housing 2', which front side faces the stepping plate 16'. Axle journals 10'*a*, 10'*b* are, however, attached to the shoulder 2'*c*.

In contrast to the bearing part 11 in the first embodiment, the bearing part 11' is designed plate-shaped with an upper space 11'*p* being recessed into the plate, which space has on both side surfaces upwardly open recesses $11'k_1$, $11'k_2$. The two axle journals 10'*a*, 10'*b* are during installation introduced into the recesses $11'k_1$, $11'k_2$.

Furthermore a recess 11'*m*, which is approximately of an inverted T-shape in the front view, exists in the bearing part 11', the of stem which recess projects upwardly from the cross bar section. The pull rod 6' extends through a bearing bore in the partition 2'*a* of the housing 2 and is thereafter guided through the recess 11'*m* of the bearing part 11' and is at its end swaged to the vertical leg 9'*a*.

The relationships during a backward fall correspond with the relationships of the first embodiment. During a backward twisting fall of the skier, the bearing part 11' is initially moved upwardly with both recesses $11'k_1$, $11'k_2$ moving therewith. The cross bar section of the T-shaped recess 11'*m*, which section extends in the transverse direction, moves thereby into the area of the pull rod 6', thus enabling, similarly to the first exemplary embodiment, a lateral horizontal pivoting of the bearing part 11'.

It is not necessary here to provide a separate projection (corresponding to the projection 2*g*) arranged on the front side 2'*b* of the housing 2, since the purpose of the projection (namely, the centering of the bearing part in the cavity) is taken over by the vertically upright stem of the T-shaped recess 11'*m* in cooperation with the pull rod 6'. This cooperation of recess 11'*m* and pull rod 6' also guarantees the controlled diagonal release.

The invention is not to be limited to the above-described exemplary embodiments illustrated in the drawings. Rather various modifications of the same are possible without departing from the scope of the invention. For example, it is possible to exchange the utilization of the projection and of the T-shaped recess in both exemplary embodiments. Furthermore, the clearance between the bearing part and the front wall of the housing can be filled with a rubber-elastic sealing material. The rollers are in both embodiments supported on the pivot axes for the angle levers. However, it is also possible to arrange the rollers on axes which are independent from the pivot axes of the angle levers.

The embodiments of the invention in which an exclusive property or privilege is claimed are defined as follows:

1. In a front jaw of a ski binding provided with two laterally spaced two-arm levers adapted to hold a ski boot to be inserted therein, each said two-arm lever having a short arm and a long arm, each of said long arms being supported for pivotal movement laterally outwardly against the force of a release spring housed in a housing, and a pull rod in said housing extending parallel to a longitudinal axis of said ski binding, the improvement wherein a bearing part is provided on the housing, wherein said two levers are supported for movement about pivot axes which are arranged on said bearing part, said bearing part being pivotal about an axis transverse of the longitudinal axis of said ski binding, said axis being located in an upper area of said housing on a side thereof facing the ski boot, and wherein each of the short arms of said two two-arm levers rest against a vertically extending leg of a slide member which is connected to said pull rod, said pull rod being tensioned by said release spring for biassing each of said long arms laterally inwardly.

2. The front jaw according to claim 1, wherein two inclined surfaces are provided on a lower area of said side of the housing facing the skit boot, said two inclined surfaces each defining an acute angle ($\alpha$) with an upper side of the ski and on which the bearing part rests with counter surfaces in the travelling position of the front jaw.

3. The front jaw according to claim 2, wherein said bearing part includes a pair of laterally spaced sections, wherein a projection is provided on said housing and is arranged between said two inclined surfaces on said housing, which projection in the travelling position of the front jaw extends into a space defined by opposing sides of said pair of sections and a cross bar of the bearing part to initially center the bearing part, said projection being removed from said space during a backward twisting fall against the force of said release spring to allow said bearing part to pivot about a further axis generally aligned with said longitudinal axis of said ski binding.

4. The front jaw according to claim 3, wherein axle journals forming the transverse axis are arranged on said opposing sides of said two sections of said bearing part, which sides face one another, which axle journals each extend with clearance into a downwardly open recess in a shoulder on said side of said housing facing the ski boot.

5. The front jaw according to claim 1, wherein a further cross bar is provided in the lower area of said bearing part between said two sections, which further cross bar abuts said vertically extending leg of said slide member.

6. The front jaw according to claim 5, wherein a front surface of said further cross bar facing the ski boot is inclined downwardly at an acute angle ($\beta$) with respect to the vertically extending leg of said slide member, an upper edge of said front surface being rounded.

7. The front jaw according to claim 1, wherein an upper region of said side of said housing facing the ski boot includes a shoulder, on which shoulder are provided two axle journals extending in transverse direction relative to the longitudinal axis of the ski binding, and wherein means defining a space is provided in the upper area in said bearing part, opposing wall surfaces of said space having upwardly opening recesses, into which recesses is received said two axle journals.

8. The front jaw according to claim 7, wherein a recess, T-shaped in a front view, is provided in said bearing part below said space, which recess includes an upstanding stem which projects upwardly and through which recess extends said pull rod, said pull rod in the travelling position of the front jaw being provided in said stem of said recess to hold said bearing part in an initial centered position and during a backward twisting fall in a cross bar section of said recess against the force of said release spring to allow said bearing part to pivot about a further axis generally aligned with said longitudinal axis of said ski binding.

9. In a front jaw for holding a ski boot onto a ski, which front jaw has a housing and two laterally extending two-arm toggle levers pivotally supported in a bearing part and which toggle levers can be pivoted laterally outwardly against the force of at least one spring provided in the housing, each said two-arm lever having a short lever arm and a long lever arm, support means for pivotally supporting said bearing part for movement about an axis extending transversely with respect to the longitudinal axis of the front jaw, the improvement wherein said housing is fixed to the ski and the bearing part is arranged on a rear crosswall of said housing, wherein said spring is a helically shaped spring, an axis of which extends generally parallel to said longitudinal axis, wherein an elongated pull rod is provided and extends longitudinally through the central part of said spring in a direction generally parallel to said axis of said spring, wherein said support means defines an axis for said bearing part, said axis being located at an upper region of said crosswall of said housing, wherein a slide member is slidably mounted for movement forward and rearward in said housing and is connected to said pull rod for movement therewith as well, said slide member having means defining vertically extending surfaces thereon, and wherein each said short lever arm of said two toggle levers rest on a respective one of the vertically extending surfaces of the slide member, said slide member being urged by said spring frontwardly to effect an urging of said long lever arms laterally inwardly.

* * * * *